US008974052B2

(12) United States Patent
Tanaka et al.

(10) Patent No.: US 8,974,052 B2
(45) Date of Patent: Mar. 10, 2015

(54) PRINTER

(75) Inventors: Mitsugi Tanaka, Nagoya (JP); Toshiyuki Furuyama, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/596,586

(22) Filed: Aug. 28, 2012

(65) Prior Publication Data

US 2013/0050385 A1 Feb. 28, 2013

(30) Foreign Application Priority Data

Aug. 30, 2011 (JP) ..... 2011-187864
Aug. 30, 2011 (JP) ..... 2011-187867

(51) Int. Cl.
*B41J 29/13* (2006.01)
*B41J 3/36* (2006.01)
*B41J 15/04* (2006.01)
*B41J 29/02* (2006.01)

(52) U.S. Cl.
CPC *B41J 3/36* (2013.01); *B41J 15/042* (2013.01); *B41J 29/02* (2013.01)
USPC ..... 347/108; 400/611; 400/88

(58) Field of Classification Search
CPC ..... B41J 29/13
USPC ..... 347/109, 104, 108; 400/88, 691
See application file for complete search history.

(56) References Cited

U.S. PATENT DOCUMENTS 5,152,623 A 10/1992 Yamada et al.
5,507,583 A * 4/1996 Beaty et al. ..... 400/611
RE35,319 E 8/1996 Yamada et al.
5,833,380 A 11/1998 Hosomi et al.
6,118,469 A 9/2000 Hosomi
6,652,170 B1 11/2003 Arnold
7,011,463 B2 * 3/2006 Matsuse ..... 400/594

(Continued)

FOREIGN PATENT DOCUMENTS

CN 1159393 9/1997
CN 1286173 3/2001

(Continued)

OTHER PUBLICATIONS

European Search Report issued in European Application No. 12182356 on Dec. 21, 2012.

(Continued)

*Primary Examiner* — Matthew Luu
*Assistant Examiner* — Lily Kemathe
(74) *Attorney, Agent, or Firm* — McCarter & English, LLP

(57) ABSTRACT

This disclosure discloses a printer configured to perform desired printing, comprising a substantially box-shaped housing, a partition wall that partitions an internal structure of the housing into a first area positioned on a first side, and a second area positioned on a second side opposite to the first side, a control substrate provided to the first area, a medium storage chamber configured to store the print-receiving medium and provided to the second area, an opening/closing lid configured to expose the medium storage chamber to the outside and provided to the housing and configured to open and close between an open position and a closed position, and a print processing mechanism configured to perform desired printing while feeding the print-receiving medium supplied from the medium storage chamber based on control by the control substrate.

8 Claims, 14 Drawing Sheets

(56) References Cited

U.S. PATENT DOCUMENTS

| | | | | |
|---|---|---|---|---|
| 7,073,717 | B1 | 7/2006 | Arnold et al. | |
| 7,553,098 | B2 * | 6/2009 | Maekawa et al. | 400/613 |
| 2004/0066447 | A1 | 4/2004 | Arnold | |
| 2004/0234316 | A1 | 11/2004 | Matsuse | |
| 2006/0216098 | A1 * | 9/2006 | Lyman | 400/613 |
| 2007/0036604 | A1 | 2/2007 | Maekawa et al. | |
| 2007/0166092 | A1 * | 7/2007 | Liu et al. | 400/613 |
| 2011/0222951 | A1 * | 9/2011 | Yahata et al. | 400/645.2 |

FOREIGN PATENT DOCUMENTS

| | | | |
|---|---|---|---|
| CN | 1530238 | | 9/2004 |
| CN | 1911671 | | 2/2007 |
| JP | 03-218872 | A | 9/1991 |
| JP | 2000-094732 | | 4/2000 |
| JP | 2002-011908 | | 1/2002 |
| JP | 2002-178564 | | 6/2002 |
| JP | 2004-082432 | | 3/2004 |
| JP | 2009-029092 | A | 2/2009 |
| WO | 98/17475 | | 4/1998 |

OTHER PUBLICATIONS

Chinese Office Action issued in Application No. 201210313392.8 on May 4, 2014.

Chinese Office Action issued in Application No.: 201210313392.8 on Nov. 15, 2014.

* cited by examiner

PRINTER

CROSS-REFERENCE TO RELATED APPLICATION

The present application claims priority from Japanese Patent Application No. 2011-187867, which was filed on Aug. 30, 2011, and 2011-187864, which was filed on Aug. 30, 2011, the disclosures of which are incorporated herein by reference in its entirety.

BACK GROUND

1. Field

The present disclosure relates to a printer that performs desired printing on a print-receiving medium.

2. Description of the Related Art

There is disclosed a first prior art of a printer that provides a medium storage chamber that stores a print-receiving medium in the interior of a housing. In this printer, the medium storage chamber can be opened to the outside using an opening/closing lid (printer cover) provided to the housing (printer case). With this arrangement, the operator can easily insert the print-receiving medium (rolled paper) into the medium storage chamber and replace the print-receiving medium with a new print-receiving medium by setting the opening/closing lid into an open position and exposing the medium storage chamber to the outside. Note that the opening/closing operation of the opening/closing lid is detected by a sensor (cover open detector).

Further, for example, a second prior art is disclosed, comprising a printer that is battery powered and configured to perform a printing operation using the electromotive force of a battery. This printer comprises a medium storage chamber (paper supply cassette) that stores a sheet-shaped print-receiving medium laid flat, a print processing mechanism comprising a platen roller and a thermal head, and a control substrate, in the interior of the housing (main body cover). Further, a battery storage part (battery) is provided in a detachable manner behind the housing. The print processing mechanism uses the power supplied from the battery stored in the battery storage part, and performs desired printing on the print-receiving medium based on the control executed by the control substrate.

According to the first prior art, the sensor that detects the opening/closing operation of the opening/closing lid is provided to the side where the opening/closing lid is opened to the outside. In this case, when the opening/closing lid changes to an open state and the housing interior is open to the outside, the possibility exists that spray from the outside, such as rain water, will adversely affect the control substrate of the housing interior. Nevertheless, according to the first prior art, such effects of spray in the housing interior in particular has not been specially considered.

In a printer such as that of the second prior art, a roll-shaped print-receiving medium is sometimes used, for example. When such a roll-shaped print-receiving medium is stored with the axial direction thereof horizontally set, the vertical dimension of the medium storage chamber becomes relatively large. On the other hand, the control substrate, in general, is often extended in the horizontal direction as in the prior art for the convenience of handling and assembly. As a result, the control substrate has a small vertical dimension but a relatively large horizontal dimension. Further, from the viewpoints of stability and the placement of the center of gravity, the battery is often stored horizontally. In such a case, as in the second prior art, the battery storage part has a small vertical dimension and a relatively large horizontal dimension.

It is possible to reduce the size of the housing by devising a layout of such a roll-shaped print-receiving medium, control substrate, and battery storage part within the apparatus while considering the respective dimensional characteristics of the same. Nevertheless, according to the second prior art, consideration to such a point has not been made.

SUMMARY

It is therefore a first object of the present disclosure to provide a printer capable of ensuring the waterproof characteristics of the housing interior.

It is a second object of the present disclosure to provide a printer capable of reducing the size of the overall housing.

To achieve the first and second objects, according to the present aspect, there is provided a printer configured to perform desired printing on a print-receiving medium wound around a predetermined axis into a roll shape, comprising a substantially box-shaped housing that constitutes a printer contour, a partition wall that partitions an internal structure of the housing into a first area positioned on a first side along a first direction orthogonal to the axis, and a second area positioned on a second side opposite to the first side along the first direction, a control substrate provided to the first area, a medium storage chamber configured to store the print-receiving medium and provided to the second area, an opening/closing lid configured to expose the medium storage chamber to the outside and provided to the housing and configured to open and close between an open position and a closed position, and a print processing mechanism configured to perform desired printing while feeding the print-receiving medium supplied from the medium storage chamber based on control by the control substrate.

According to the printer of the present disclosure, a medium storage chamber configured to store a print-receiving medium is provided to the interior of the housing, and this medium storage chamber is opened to the outside using an opening/closing lid provided to the housing. With this arrangement, the operator can easily insert the print-receiving medium into the medium storage chamber and replace the print-receiving medium with a new print-receiving medium by setting the opening/closing lid into an open position and exposing the medium storage chamber to the outside.

At that time, because the housing interior is open to the outside, there is a need to consider the waterproof characteristics of the control substrate in the housing interior. According to the present disclosure, a partition wall is provided to the housing interior, partitioning the interior into a first area on a first side and a second area on a second side, with the medium storage chamber that is configured to open and close by the opening/closing lid provided in the second area and the control substrate provided in the first area. With this arrangement, it is possible to ensure the waterproof characteristics of the control substrate.

Further, according to the printer of the present disclosure, the housing is divided into a first area of a first side and a second area of a second side along a first direction, as previously described. Then, the control substrate is disposed in the first area, and the medium storage chamber is disposed in the second area. With this arrangement, it is possible to dispose the battery storage part vertically with the control substrate in the first area, and thus provide the medium storage chamber alone in the second area. In this case, it is possible to suppress an increase in the vertical dimension of the housing compared to a case where the control substrate and battery storage part are provided above and below the medium storage chamber. Further, the battery storage part and control substrate are vertically layered and disposed in the first area on a side opposite to the medium storage chamber, making it possible to suppress an increase in the horizontal dimension of the housing compared to a case where these are disposed side by side in the horizontal direction. As a result, the size of the overall housing can be reduced.

DETAILED DESCRIPTION OF THE PREFERRED EMBODIMENTS

The following describes one embodiment of the present disclosure with reference to accompanying drawings.

General Configuration of Printer

Figure 1:
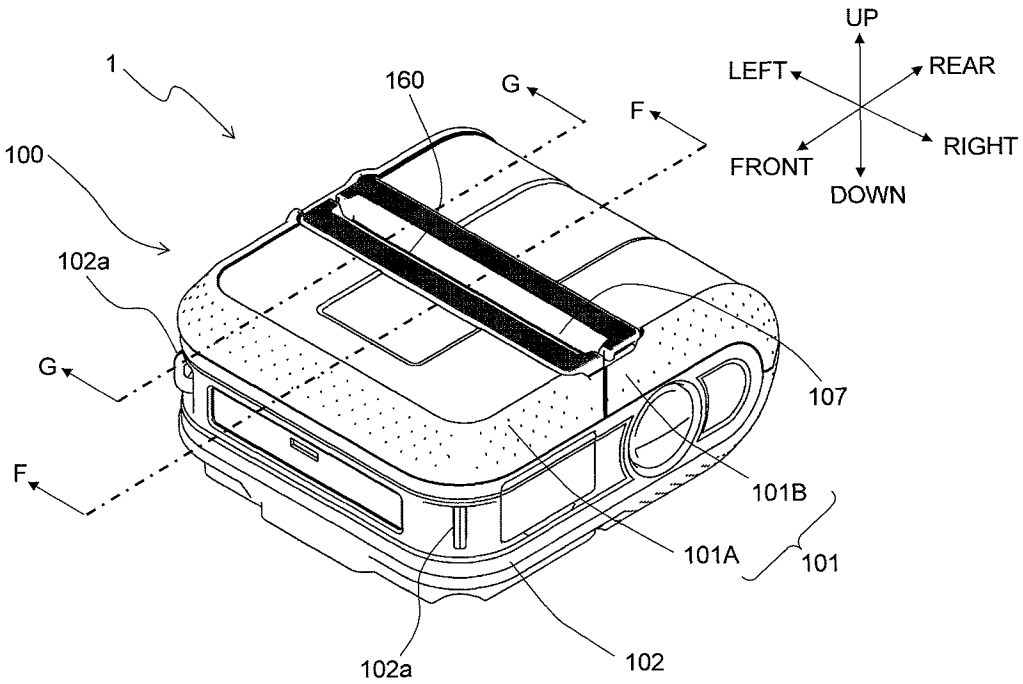
FIG. 1 is a perspective view showing the outer appearance configuration of a printer which is an embodiment of the present disclosure.
Figure 2:
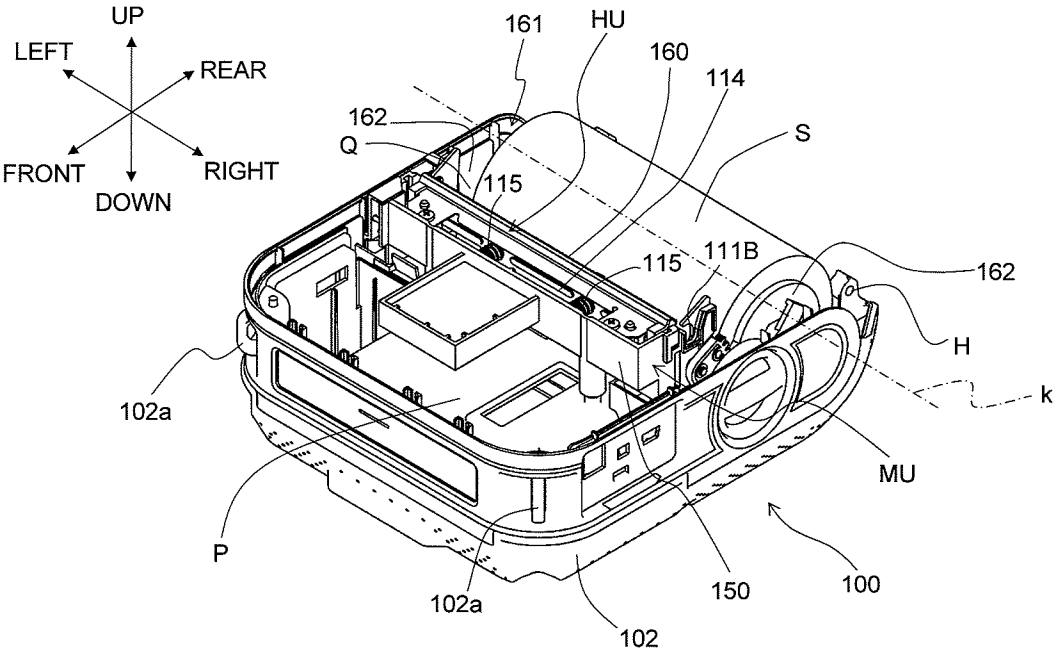
FIG. 2 is a perspective view of a state in which the top cover of the housing is removed, as viewed from a front oblique angle from above.
Figure 3A:
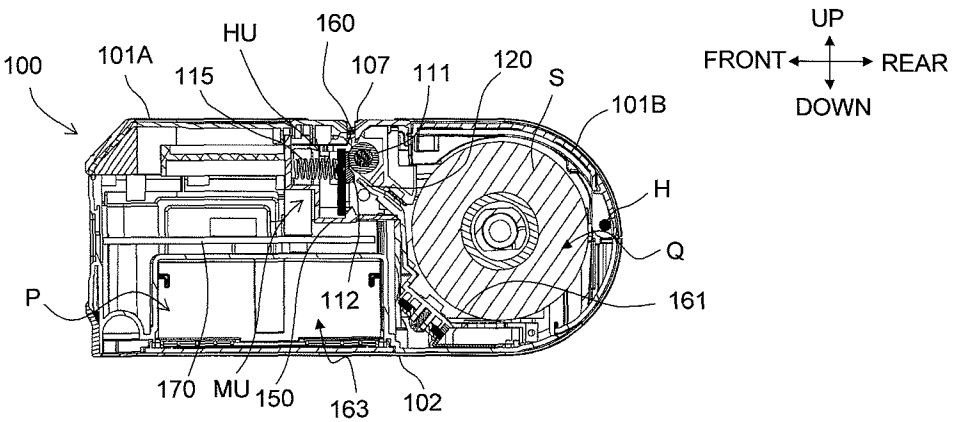
FIG. 3 shows cross-sectional views along line F-F and along line G-G in FIG. 1.

The following describes the overall configuration of a printer 1 of one embodiment of the present disclosure, using FIG. 1 to FIG. 3. In the description, the lower right direction, upper left direction, upper right direction, lower left direction, upper direction, and lower direction in FIG. 1 are defined as the right, left, rear, front, up, and down directions, respectively (refer to the arrows of each figure).

The printer 1 prints print data received from an external device (not shown) such as a PC terminal, cellular telephone, or the like onto a rolled paper S, for example. This printer 1 can be driven using a battery (not shown) as a power source.

The printer 1 comprises a substantially box-shaped housing 100 which constitutes the contour of the printer and is made of a resin material, for example. This housing 100 comprises a top cover 101 that constitutes the upper part of the printer contour, and an undercover 102 that constitutes the lower part of the printer contour. The top cover 101 comprises a fixing part 101A and an opening/closing lid 101B.

The end part of the undercover 102 is equipped with a pair of left and right insertion parts 102*a*. A strap SP (refer to FIG. 14 described later), etc., is inserted through these insertion parts 102*a* and suspended around a shoulder, neck, waist belt, or the like, for example, making it possible for the operator to readily carry and use the printer 1, which is driven by a battery as described above, in various locations (including outdoors; refer to FIG. 14 described later).

A roll storage part 161 is provided below the opening/closing lid 101B of the top cover 101 (in the interior of the housing 100; refer to FIG. 2 and FIG. 3). The rolled paper S wound around a predetermined axis k is rotatably axially supported by a support member 162 at both ends and stored in this roll storage part 161, resulting in a configuration that is capable of continually supplying the rolled paper S from the roll storage part 161. At this time, the opening/closing lid 101B is rotatably connected to a rear end part of the undercover 102 via a hinge H, making it possible to switch between an open state in which the roll storage part 161 is exposed to the outside, and a closed state in which the roll storage part 161 is stored internally. With the opening/closing lid 101B set to an open state, the roll storage part 161 is exposed to the outside of the printer, making easy insertion and replacement of the rolled paper S possible.

Further, a discharging exit 107 for discharging the rolled paper S after printing is provided to the substantial center of the top cover 101 in the front-rear direction (the section where the fixing part 101A and the opening/closing lid 101B meet according to this example; refer to FIG. 1 and FIG. 3). At this time, the discharging exit 107 is provided so that it opens toward one side along the vertical direction (upward according to this example).

Figure 12:
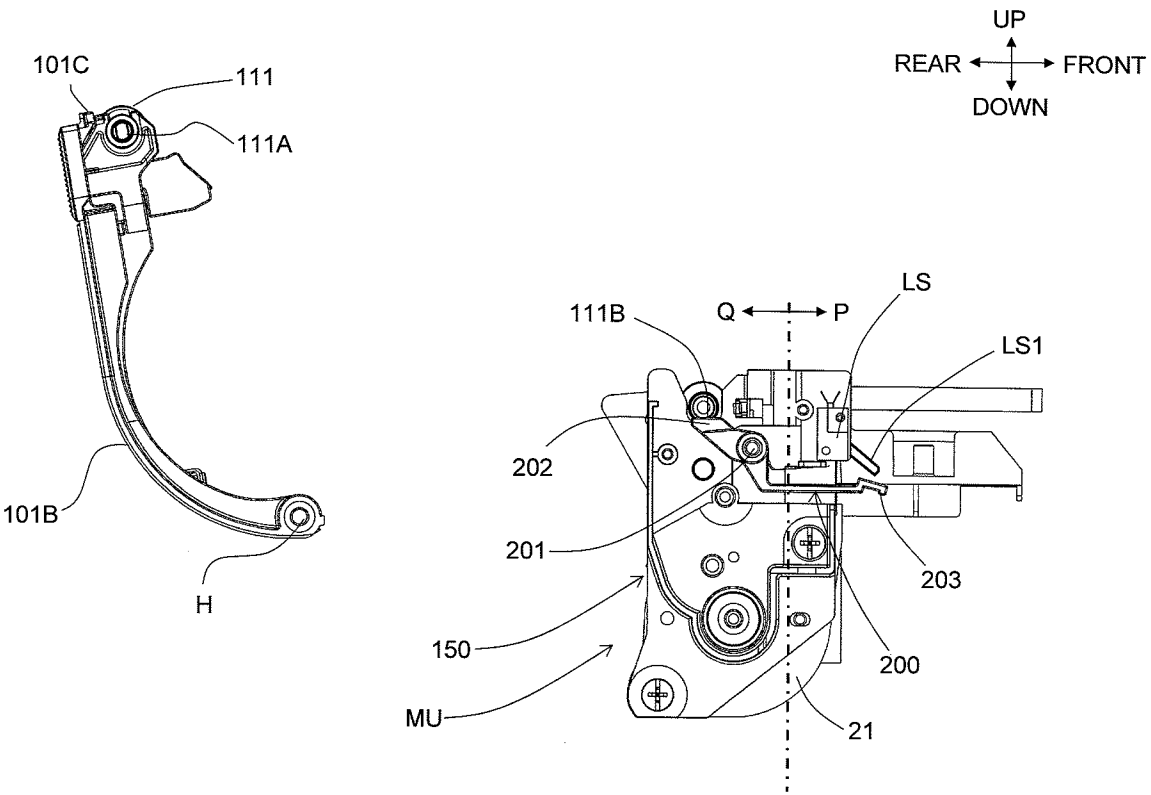
FIG. 12 is an explanatory view showing a state of the motion transmission mechanism and motion detection sensor when the opening/closing lid is in an open position.
Figure 13:
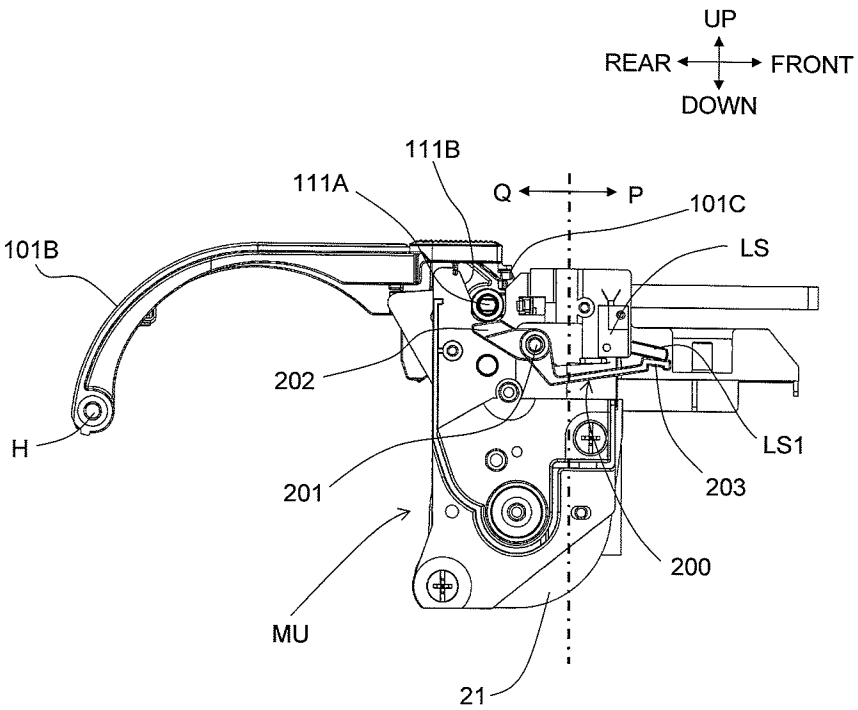
FIG. 13 is an explanatory view showing a state of the motion transmission mechanism and motion detection sensor when the opening/closing lid is in a closed position.

A platen roller 111 is rotatably supported by a front end part 101C of the opening/closing lid 101B (refer to FIG. 12 and FIG. 13 described later). The platen roller 111 feeds the rolled paper S by transmitting the rotation of the rotator (not shown) of a drive motor within a motor casing 21 when the opening/closing lid 101B is in the above described closed state.

Mechanical Unit and Periphery

Figure 3B:
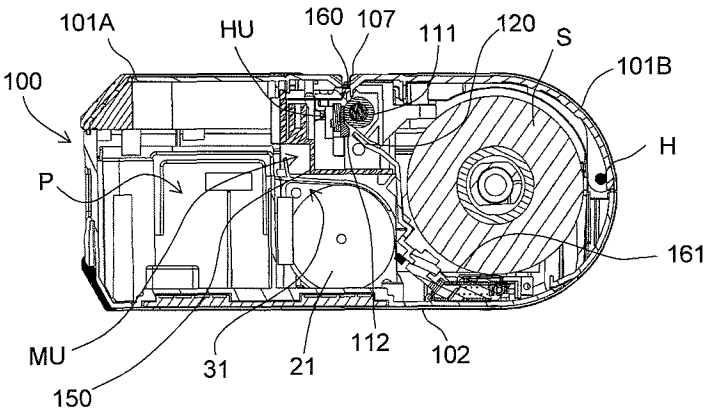
Figure 4:
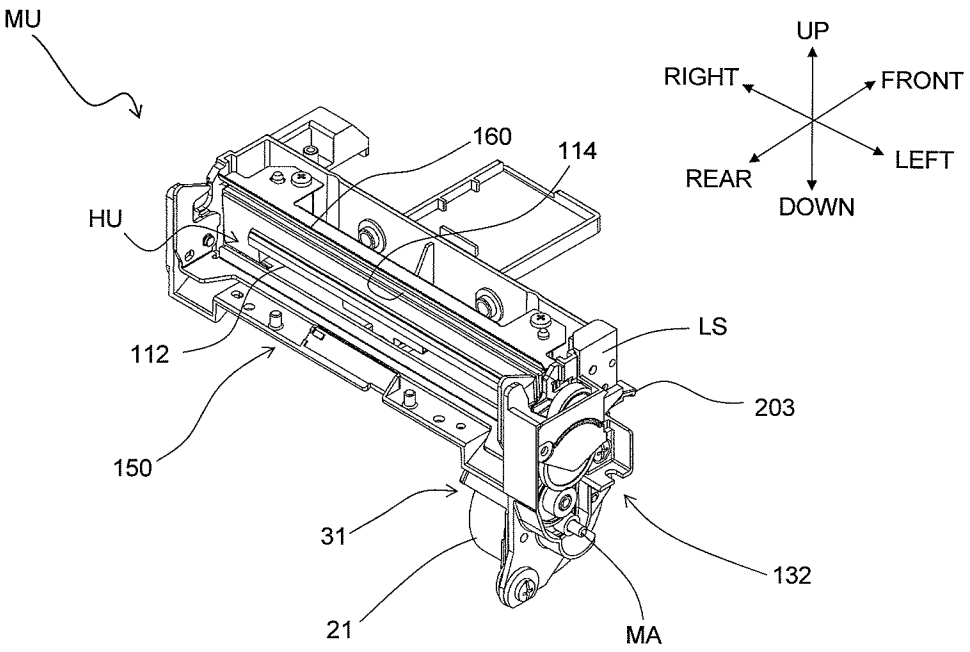
FIG. 4 is a perspective view showing the detailed structure of the mechanical unit.
Figure 5A:
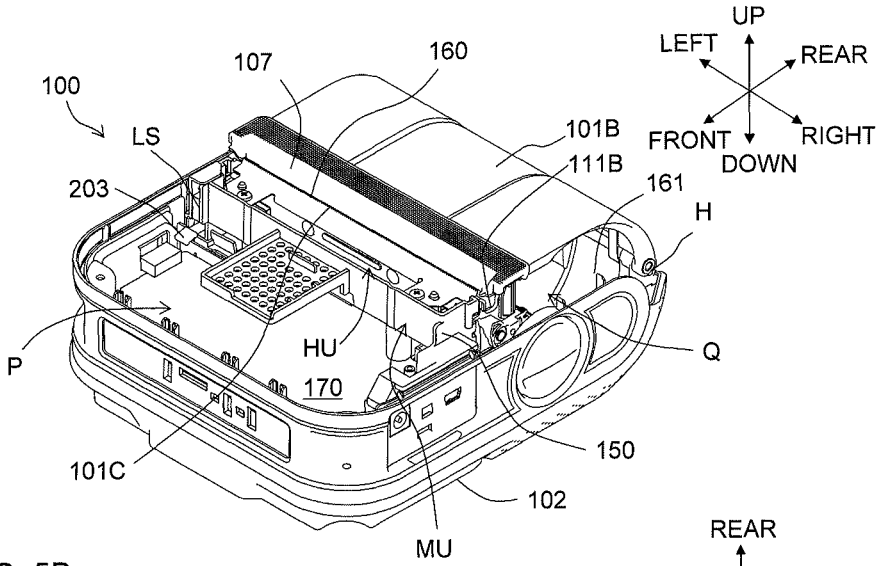
FIG. 5 shows perspective and planar views showing a state in which the fixing part of the top cover of the housing is removed, as viewed from a front oblique angle from above.
Figure 5B:
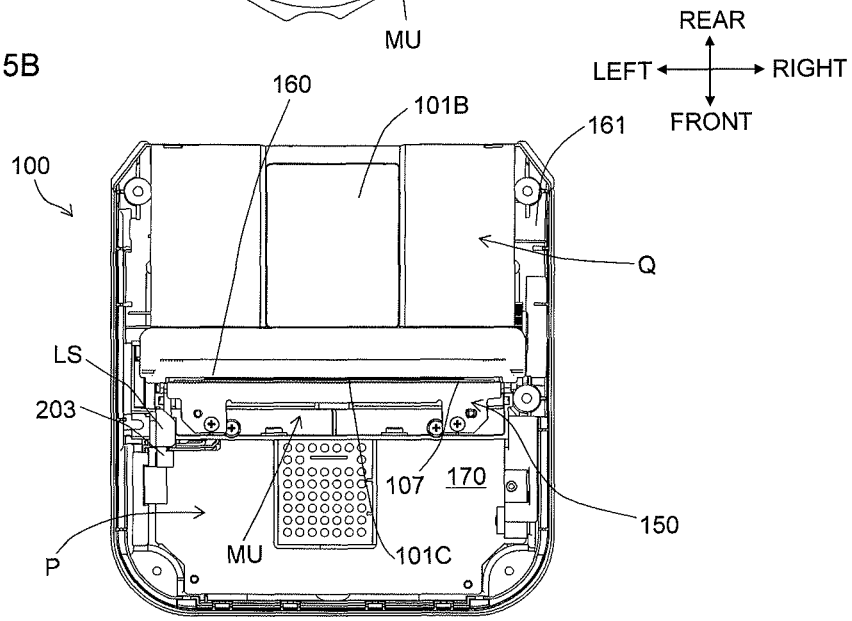
Figure 6A:
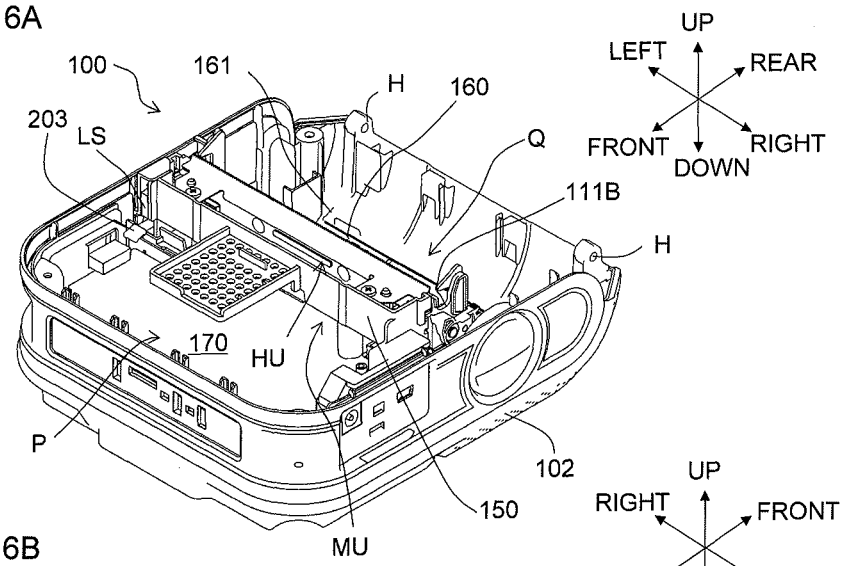
FIG. 6 shows perspective views showing a state in which the entire top cover of the housing is removed, as viewed from a front oblique angle from above and a rear oblique angle from above.
Figure 6B:
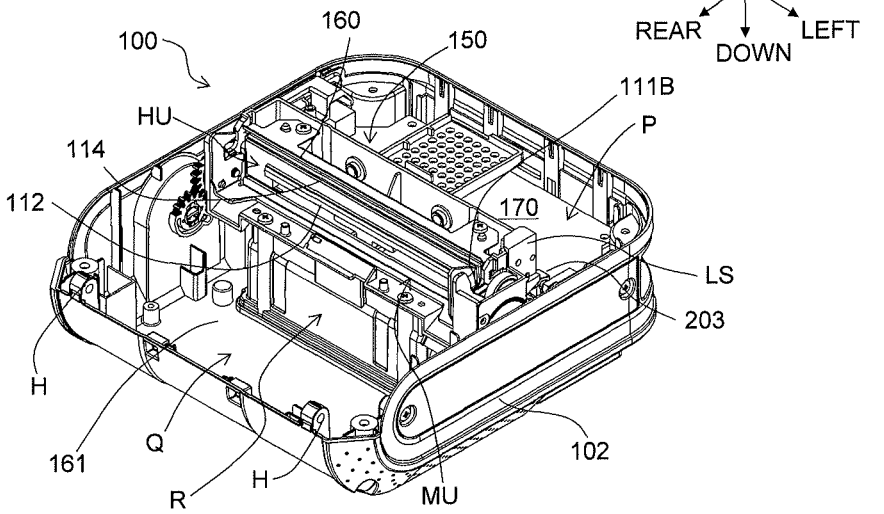

On the other hand, a mechanical unit MU comprising a main chassis member 150 is provided near the center of the interior of the housing 100 in the front-rear direction. FIG. 4 shows the detailed configuration of the mechanical unit MU. As shown in FIG. 4 and the above described FIGS. 2 and 3, a head unit HU is rockably disposed in the front-rear direction in the interior of the main chassis member 150 of the mechanical unit MU. Then, the head unit HU is integrally equipped with a thermal line head 112 and a heat sink 114 for cooling the generated heat in this thermal line head 112. Then, the front end part of the heat sink 114 is energized toward the above described platen roller 111 side (that is, the rear side) by a plurality of (two according to this example) coil springs 115 supported by the main chassis member 150. With this arrangement, when the opening/closing lid 101B is in the above described closed state, the thermal line head 112 contacts the platen roller 111 using a predetermined contact pressure.

Further, the substantially cylindrical motor casing 21 that forms the contour of the drive motor that generates driving power for rotationally driving the platen roller 111, and a gear mechanism 132 comprising a plurality of gears and configured to transmit the driving power of the above described drive motor to the platen roller 111 by being operatively connected to the platen roller 111 with the opening/closing lid 101B in a closed state, are provided to the mechanical unit MU, as shown in FIG. 4, on the left side of the main chassis member 150. The motor casing 21 is provided below the above described discharging exit 107, in the interior of the housing 100 (refer to FIG. 3B previously described). The drive of the above described drive motor is controlled by a control substrate 170 (refer to FIG. 3) disposed from below the mechanical unit MU to the rear of the housing 100 interior. Note that the control substrate 170 extends horizontally according to this example in order to improve the ease of handling and assembly. The control substrate 170 controls the thermal line head 112 of the mechanical unit MU, the above described drive motor, and the like, while using the power supplied from the above described battery.

Further, the above described motor casing 21 is provided below the above described discharging exit 107, in the interior of the housing 100 (refer to FIG. 3B previously described). As a result, in a case where the printer 1 is used in an environment where there is potential for exposure to rain and other water, such as an outdoor environment or a wet environment within a building, the spray may enter the interior of the housing 100 form the discharging exit 107 and adversely affect the motor, for example. Here, according to this embodiment, a motor cover 31 that covers the motor casing 21 that forms the contour of the above described drive motor is provided. Further, the left-right direction of the motor casing 21 is established as the axial direction thereof, and a motor axis MA of the drive motor is provided protruding from the motor casing 21 toward the left.

Further, the area below the control substrate 170 within the housing 100 is equipped with a battery storage part 163 (see FIG. 3) wherein the above described battery is inserted and disposed from the lower surface side of the undercover 102. Note that, according to the battery storage part 163, the above described battery is stored horizontally from the viewpoints of stability and the placement of the center of gravity, although not shown. Then, the above described control substrate 170 controls the thermal line head 112, the above described drive motor, etc., while using the power supplied from the battery stored in the above described battery storage part 163.

General Operation of Printer

With the above described configuration, the print data is sent to the printer 1 via wireless communication (or wired or infrared communication) from an external device such as a PC terminal or cellular telephone at the time of printing. Further, the rolled paper S is fed out from the roll storage part 161 by the rotation of the platen roller 111 based on the driving power of the motor. The fed out rolled paper S is guided to a pressing part of the platen roller 111 and the thermal line head 112 by a guide member 120 provided below the discharging exit 107. Then, the thermal line head 112 performs printing in a desired form based on the print data onto the rolled paper S inserted between the thermal line head 112 and the platen roller 111. The rolled paper S after printing is discharged from the discharging exit 107 to outside the housing 100. At this time, a fixed tooth 160 is installed to the main chassis member 150, along and inside the discharging exit 107. Upon completion of the printing above, the operator can manually cut the end part of the rolled paper S discharged from the discharging exit 107 using this fixed tooth 160.

Note that when the operator opens the opening/closing lid 101B and stores the rolled paper S in the roll storage part 161 as described above, the operator inserts the end excess part of the rolled paper S extracted from the roll storage part 161 between the thermal line head 112 of the mechanical unit MU and the platen roller 111 provided to the opening/closing lid 101B side, and further inserts the end excess part through the discharging exit 107, exposing it to the outside of the housing 100, to smoothly achieve the feeding and printing operation during the subsequent printing operation as described above, and then needs to close the opening/closing lid 101B. Here, in this embodiment, a front end part 101C of the above described opening/closing lid 101B also serves as the edge part on the rear side (in other words, the roll storage part 161 side) of the discharging exit 107.

Further, in a case where a paper jam or the like occurs during printing, the platen roller 111 is released from the thermal line head 112 by opening the above described opening/closing lid 101B of the top cover 101, making it possible to easily pull out the rolled paper S.

First Special Characteristic of this Embodiment

In the above configuration, first, the first special characteristic of this embodiment lies in the configuration for detecting the opening and closing of the above described opening/closing lid 101B while improving the waterproof characteristics against spray. The following describes the details on the functions in order using FIG. 5 to FIG. 13.

As previously described, according to the printer 1 of this embodiment, the roll storage part 161 can be opened to the outside using the opening/closing lid 101B. With this arrangement, it is possible for the operator to easily insert the rolled paper S into the roll storage part 161 and replace the rolled paper S with a new rolled paper S by setting the opening/closing lid 101B into an open position and exposing the roll storage part 161 to the outside. At this time, because the interior of the housing 100 is open to the outside, it is necessary to consider the waterproof characteristics of the control substrate 170 inside the housing 100.

Figure 7A:
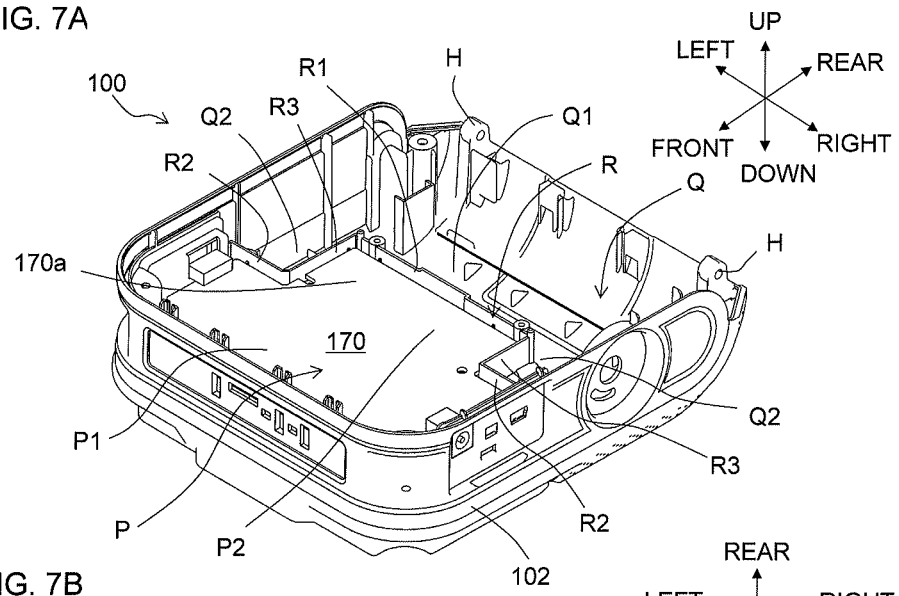
FIG. 7 shows perspective and planar views showing a state in which the entire top cover of the housing and the mechanical unit are removed, as viewed from a front oblique angle from above.
Figure 7B:
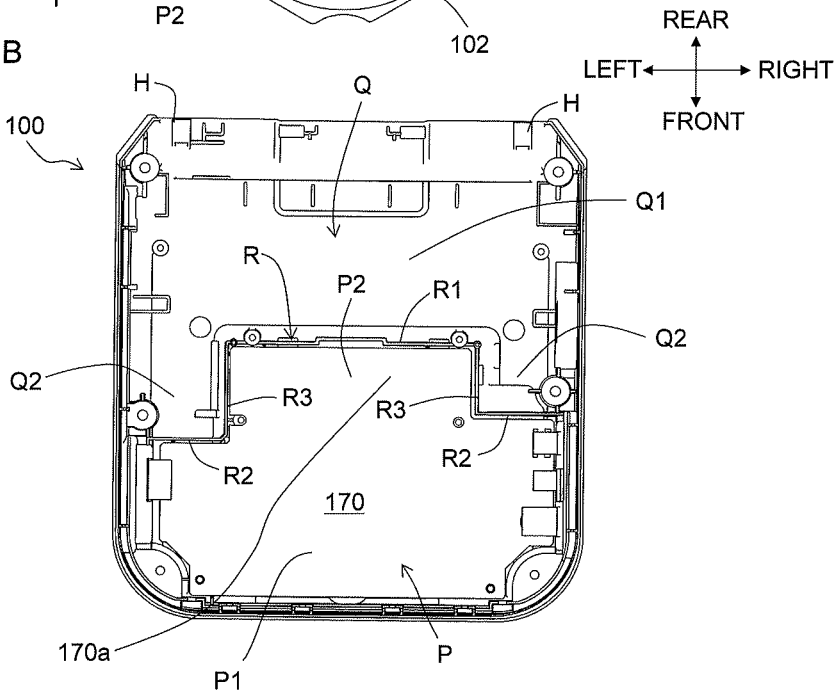
Figure 8:
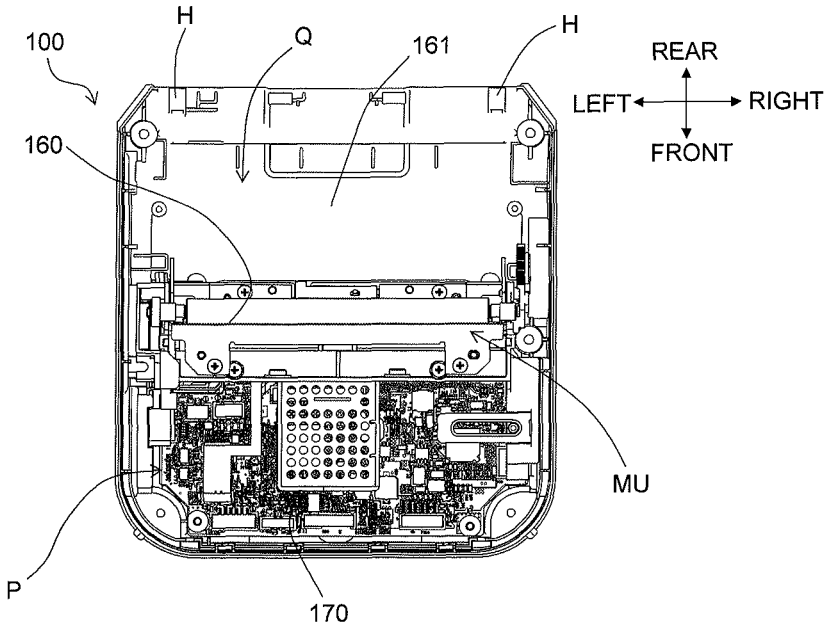
FIG. 8 is a planar view showing a state in which the entire top cover of the housing is removed.

Here, according to the printer 1 of this embodiment, as shown in FIG. 5 to FIG. 7, in order to partition the inner structure of the housing 100 into a first area P of one side (front side) in the horizontal direction and a second area Q of the other side (rear side) in the horizontal direction, a partition wall R is erected from an inner bottom part of the undercover 102 at a boundary part between the first area P and the second area Q. Further, the above described roll storage part 161 that is opened and closed by the opening/closing lid 101B is provided to the second area Q, and each of the electrical components, including the control substrate 170, (not shown; hereinafter simply referred to as the "control substrate 170, etc.") is provided to the first area P. Furthermore, as shown in FIG. 5 and FIG. 6, the mechanical unit MU is provided so that it covers the upper part of the partition wall R that partitions the first area P and the second area Q. At this time, the mechanical unit MU, as previously described, includes the drive motor that forms the contour of the motor casing 21 and the head unit HU, and is fixed by a screw onto the partition wall R. With this arrangement, the area between the second area Q, which can be opened to the outside as described above, and the first area P, which has the control substrate 170, etc., is sealed by the partition wall R and the main chassis member 150. As a result, it is possible to ensure the waterproof characteristics of the control substrate 170, etc.

Second Special Characteristic of this Embodiment

Further, the second special characteristic of this embodiment lies in that the control substrate 170, the battery storage part 163, and the roll storage part 161 are disposed within the housing 100 as previously described. The following describes the details on the functions in order using the above described FIGS. 5 to 7, FIG. 8, FIG. 9, and FIG. 10.

As previously described, according to the printer 1 of this embodiment, the roll storage part 161, the mechanical unit MU comprising the thermal line head 112, the drive motor, the main chassis member 150, and the like, the battery storage part 163, and the control substrate 170 are provided within the housing 100.

At this time, when the rolled paper S is stored in the roll storage part 161 with the axis thereof horizontally set as in this embodiment, the vertical dimension of the roll storage part 161 becomes relatively large (see FIG. 2 and FIG. 3). Further, when the control substrate 170 is extended substantially horizontally as in this embodiment, the vertical dimension of the control substrate 170 is small but the horizontal dimension thereof becomes relatively large. Furthermore, when the battery is horizontally stored as in this embodiment, the vertical dimension of the battery storage part 163 is small, but the horizontal dimension thereof becomes relatively large (see FIG. 3).

Here, according to the printer 1 of this embodiment, as shown in FIG. 5 and FIG. 6, the interior of the housing 100 is divided into the first area P on one side (the front side according to this example) in the front-rear direction, and the second area Q on the other side (the rear side according to this example) of the front-rear direction. Then, the battery storage part 163 is provided to the lower part of the first area P, and the control substrate 170 is provided to the upper part of the first area P. That is, the battery storage part 163 (see FIG. 3A) and the control substrate 170, both having large horizontal dimensions, are disposed vertically in the first area P. Further, the roll storage part 161 having a large vertical dimension is disposed in the second area Q. Note that the above described mechanical unit MU is disposed near the border of the first area P in which the above described battery storage part 163 and control substrate 170 are disposed and the second area Q where the roll storage part 161 is disposed.

With the roll storage part 161 provided alone in the second area Q as described above, an increase in the vertical dimension of the housing 100 is suppressed compared to a case where the control substrate 170 and the battery storage part 163 are provided above and below the roll storage part 161. Further, the battery storage part 163 and the control substrate 170 are vertically layered and disposed in the first area P on the opposite side, suppressing an increase in the horizontal dimension of the housing 100 compared to a case where these are disposed side by side in the horizontal direction.

Protruding Shape of Control Substrate

In relation to the above described first special characteristic, as shown in FIG. 7, in this embodiment, the control substrate 170 comprises a protruding substrate part 170*a* that protrudes, entering below the main chassis member 151 of the mechanical unit MU. Conversely, the first area P inside the housing 100 comprises a first base area part P1, which is a normal section, and a first protruding area part P2, which protrudes from the first base area part P1 to the roll storage part 161 side, disposing the above described protruding substrate part 170*a* in this first protruding area part P2.

Figure 10A:
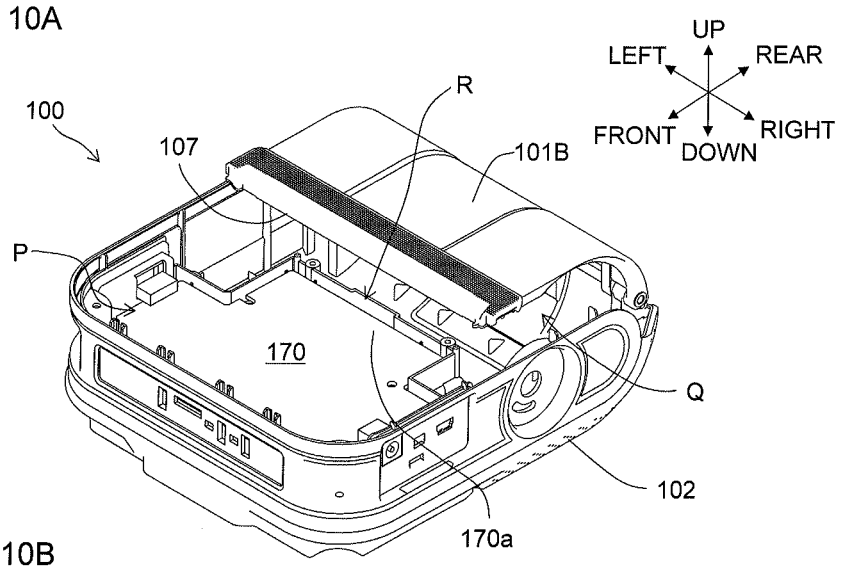
FIG. 10 shows perspective and planar views showing a state in which the fixing part of the top cover of the housing and the mechanical unit are removed, as viewed from a front oblique angle from above.
Figure 10B:
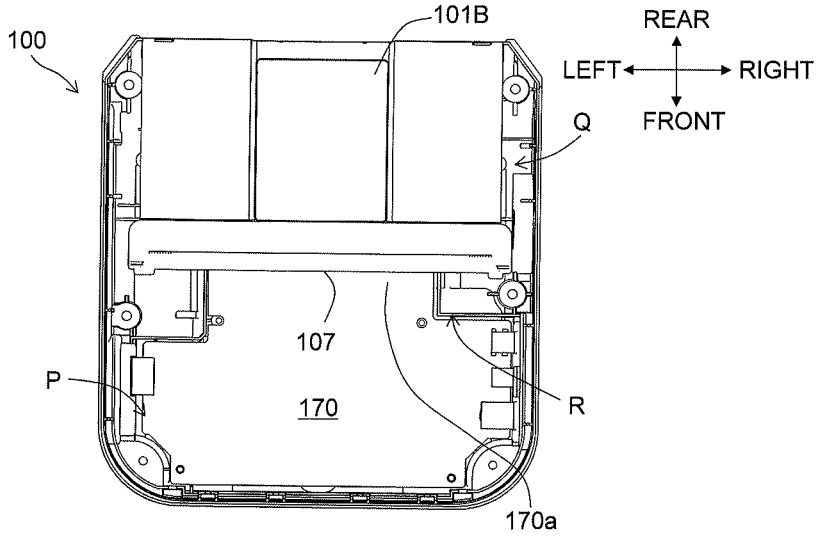

At this time, the above described discharging exit 107 is positioned above the protruding substrate part 170*a* (see FIG. 10). The discharging exit 107 opens to the housing 100, regardless of the open/closed state of the opening/closing lid 101B, requiring consideration of the waterproof characteristics of the protruding substrate part 170*a* against the spray that can enter from the discharging exit 107. Here, in this embodiment, as previously described, the protruding substrate part 170*a* is disposed so that it enters below the main chassis member 150. In other words, the main chassis member 150 is disposed so that it covers the protruding substrate part 170*a*.

On the other hand, the second area Q inside the housing 100 comprises a second protruding area part Q2 neighboring the above described first protruding area part P2 in the left-right direction so as to correspond to the protruding shape of the first protruding area part P2. At this time, the second area Q comprises a second base area part Q1 disposed further rearward toward the roll storage part 161 side than the second protruding area part Q2, and this second base area part Q1 is disposed opposing the roll storage part 161 side (in other words, the rear side) of the above described first protruding area part P2. Note that both the left and right end sections of the above described mechanical unit MU are inserted and disposed in these two left and right second protruding area parts Q2. That is, the above described motor casing 21 and the gear mechanism 132 (refer to FIG. 4), which constitute the left end section of the mechanical unit MU, are inserted and disposed in the second protruding area part Q2 on the left side. On the other hand, a release mechanism (details not shown), which constitutes the right end section of the mechanical unit MU, is inserted and disposed in the second protruding area part Q2 on the right side.

Specific Configuration of Partition Wall

Figure 9A:
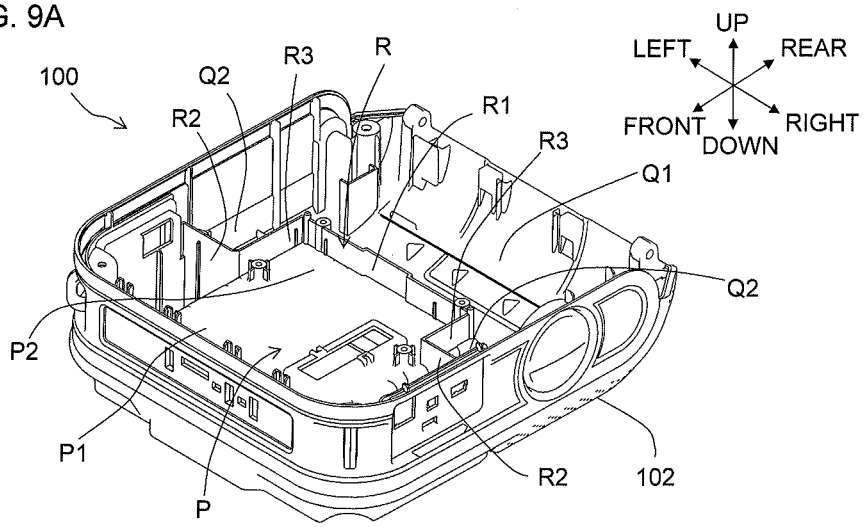
FIG. 9 shows perspective and planar views showing a state in which the entire top cover of the housing, the mechanical unit, and the control substrate are removed, as viewed from a front oblique angle from above.
Figure 9B:
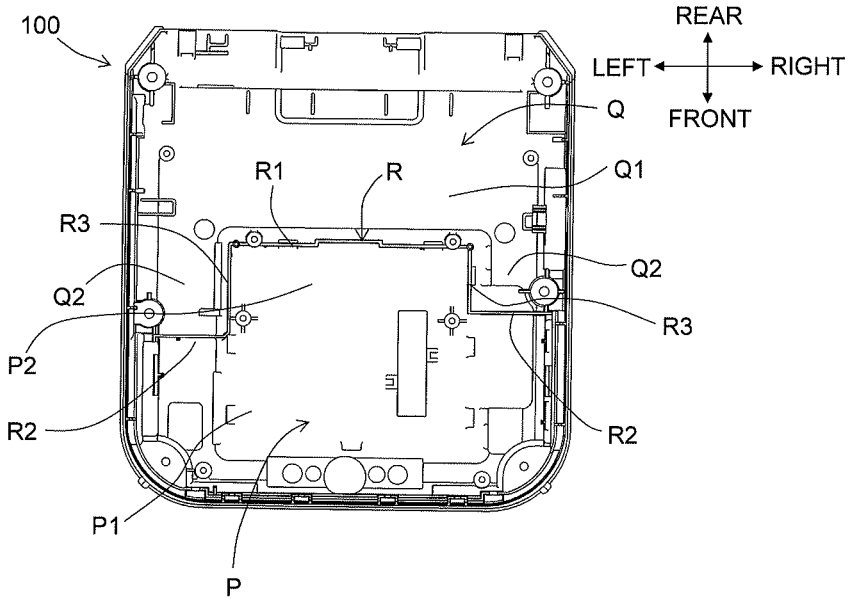

According to this embodiment, as shown in FIGS. 5 to 7, FIG. 9, and FIG. 10, the partition wall R comprises a first partition part R1, a second partition part R2, and a third partition part R3 corresponding to the boundary part between the above described first protruding area part P2 of the first area P and the second protruding area part Q2 of the second area Q. The first partition part R1 extends along the left-right direction, partitioning the first protruding area part P2 and the second base area part Q1, and is disposed so that it is positioned at the protruding end of the protruding substrate part 170*a*, sliding under the main chassis member 150 of the mechanical unit MU. The second partition part R2 is positioned further toward the front than the first partition part R1 and extends along the left-right direction, partitioning the second protruding area part Q2 and the first base area part P1. The third partition part R3 connects the first partition part R1 and the second partition part R2, and extends along the front-rear direction, partitioning the first protruding area part P2 and the second protruding area part Q2. As a result, the partition wall R comprising the above described first partition part R1, the second partition part R2, and the third partition part R3 forms a substantially crank shape that turns at right angles in the planar view, as shown in FIGS. 7 and 9.

At this time, the thermal line head 112 of the mechanical unit MU and the platen roller 111 disposed in an opposing manner thereto are disposed above the third partition part R3 (refer to FIGS. 5A, 5B, 6A, and 6B). Then, the above described drive motor is disposed in the second protruding area part Q2 on the left side of the second area Q, below the end part on one side in the left-right direction (the left side according to this example) of the thermal line head 112 and the platen roller 111. That is, while the thermal line head 112 and the platen roller 111 are provided above the partition wall R, the drive motor is disposed in the second protruding area part Q2 lateral to the second partition part R2 and the third partition part R3 and not above the partition wall R.

Sensor for Opening/Closing Detection

Here, according to the printer 1 of this embodiment, a sensor (motion detection sensor LS) for detecting the opening/closing operation of the opening/closing lid 101B is provided in the same manner as a regular printer having an opening/closing lid of this type. However, in a case where this sensor is provided to the second area Q, which is on the same side as the above described opening/closing lid 101B, concern arises regarding the waterproof characteristics of the sensor, as described above.

Here, in this embodiment, the motion detection sensor LS of a limit switch, etc., is provided to the first area P on a side opposite to the opening/closing lid 101B, for example (refer to FIGS. 5A, 5B, 6A, and 6B). Then, the operation of the opening/closing lid 101B is not directly detected but rather indirectly detected by the motion detection sensor LS by mechanically transmitting the operation of the opening/closing lid 101B on the second area Q side to the first area P side via a motion transmission mechanism 200 (refer to FIG. 11 described later) of a see-saw type, lever type, or the like, for example. In the following, details on the functions will be described in order.

Detailed Configuration and Operation of the Motion Detection Sensor

Figure 11:
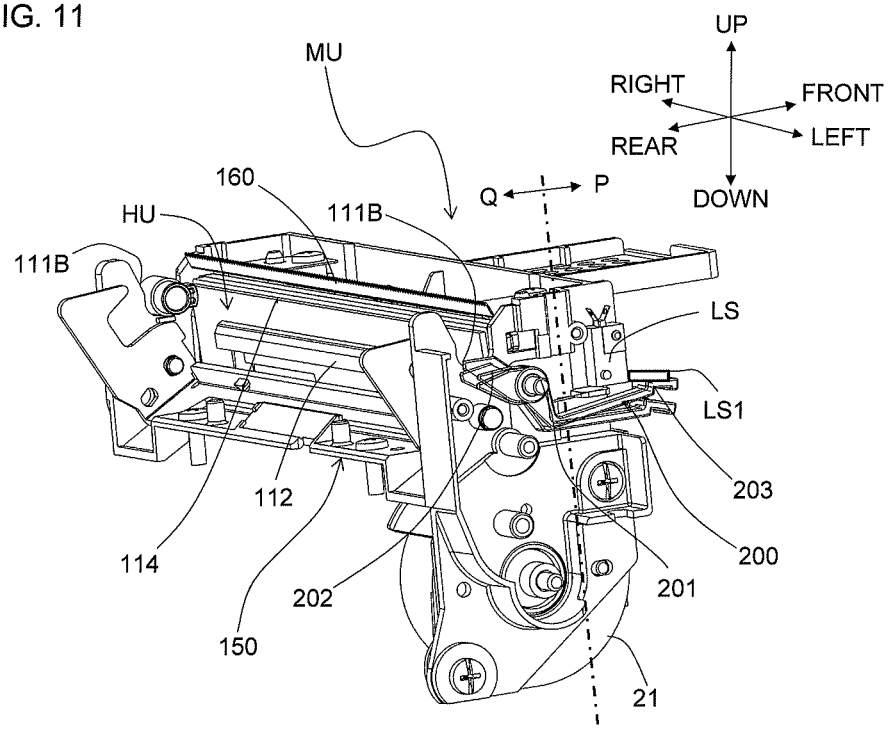
FIG. 11 is an enlarged perspective view of the mechanical unit shown in FIG. 4.

As shown in FIG. 11, the above described motion detection sensor LS is disposed in a section on the first area P side of the mechanical unit MU, which is disposed at the boundary position between the first area P and the second area Q as described above, astride the first area P and the second area Q. Then, the motion transmission mechanism 200 for transmitting the operation of the opening/closing lid 101B to the motion detection sensor LS is provided astride the above described first area P and the second area Q in a rotatably supported state via a rocking shaft 201 with respect to a lateral surface of the main chassis member 150, as shown in FIGS. 11, 12, and 13. This motion transmission mechanism 200 comprises a motion input part 202 positioned on the rear side (that is, the second area Q side) of the mechanical unit MU and the partition wall R, and a wide, rectangular shaped motion output part 203 positioned on the front side (that is, the first area P side) of the mechanical unit MU and the partition wall R.

Here, the above described opening/closing lid 101B freely rotates with respect to the undercover 102 via the hinge H provided to a base end, as previously described. Then, on the end lower surface side of the opening/closing lid 101B, both end shafts of the platen roller 111 are supported by a cylindrical bearing 111A provided in an extending manner toward the opening/closing lid 101B. When this opening/closing lid 101B is rotated in the closing direction from the above described open position (refer to FIG. 12), which opens the roll storage part 161, to the above described closed position (refer to FIG. 13), the above described bearing 111A interlocks with an interlocking concave part 111B provided to the left and right lateral upper parts of the main chassis member 150 (refer to FIG. 13). At this time, the above described motion input part 202 of the motion transmission mechanism 200 is disposed adjacent to the interlocking concave part 111B. Then, when the bearing 111A interlocks with the above described interlocking concave part 111B, the motion input part 202 is pressed downward by the bearing 111A, causing the motion transmission mechanism 200 to rock in the counterclockwise direction about the rocking shaft 201.

On the other hand, at this time, the above described motion detection sensor LS is disposed further above the above described motion transmission mechanism 200 than the motion output part 203, on the left lateral surface of the main chassis member 150. Specifically, the motion detection sensor LS is equipped with a switch lever LS 1 that slants and protrudes downward toward the first area P side, and the above described motion output part 203 is disposed in an opposing manner below that switch lever LS 1.

That is, when the opening/closing lid 101B is closed as described above on the second area Q side, the above described motion input part 202 contacts the opening/closing lid 101B that lowers toward the closed position. With this arrangement, the motion input part 202 lowers, causing the motion transmission mechanism 200 to rock in the counterclockwise direction about the rocking shaft 201. With this rocking, the lowering motion of the motion input part 202 is mechanically transmitted to the motion output part 203 positioned in the first area P, causing the motion output part 203 to rise and press upward the switch lever LS1. That is, the lowering motion of the motion input part 202 is converted to and outputted as the rising motion of the motion output part 203. With this arrangement, the motion detection sensor LS turns ON, detecting the closed state of the opening/closing lid 101B.

As described above, in the printer 1 of this embodiment, the opening/closing operation of the opening/closing lid 101B of the second area Q that is to open to the outside is transmitted to the first area P side via the motion transmission mechanism 200 and detected by the motion detection sensor LS. With this arrangement, it is possible to detect the opening/closing while ensuring the waterproof characteristics of the motion detection sensor LS. As a result, the opening/closing detection performance of the opening/closing lid 101B can be favorably maintained.

Further, in particular, according to this embodiment, the mechanical unit MU is provided to the upper part of the partition wall R, thereby sufficiently shielding the spattering of the spray from the second area Q side to the first area P by the mechanical unit MU in coordination with the partition wall R, making it possible to ensure the waterproof characteristics of the motion detection sensor LS.

Further, in particular, according to this embodiment, the motion output part 203 in the motion transmission mechanism 200 converts the lowering motion of the motion input part 202 associated with the lowering of the opening/closing lid 101B to a rising motion, outputting the motion as a rising motion. Then, the motion detection sensor LS is positioned further upward than the motion output part 203, detecting the rising motion of the motion output part 203. With this arrangement, presuming the unlikely event that the spray from the motion input part 202 of the second area Q enters and travels to the surface of the motion transmission mechanism 200, manifesting in the first area P from the motion output part 203, the motion detection sensor LS is positioned further upward than the motion output part 203, keeping the manifested spray from ever reaching the motion detection sensor LS. As a result, it is possible to prevent the motion detection sensor LS from being exposed to spray.

Figure 14:
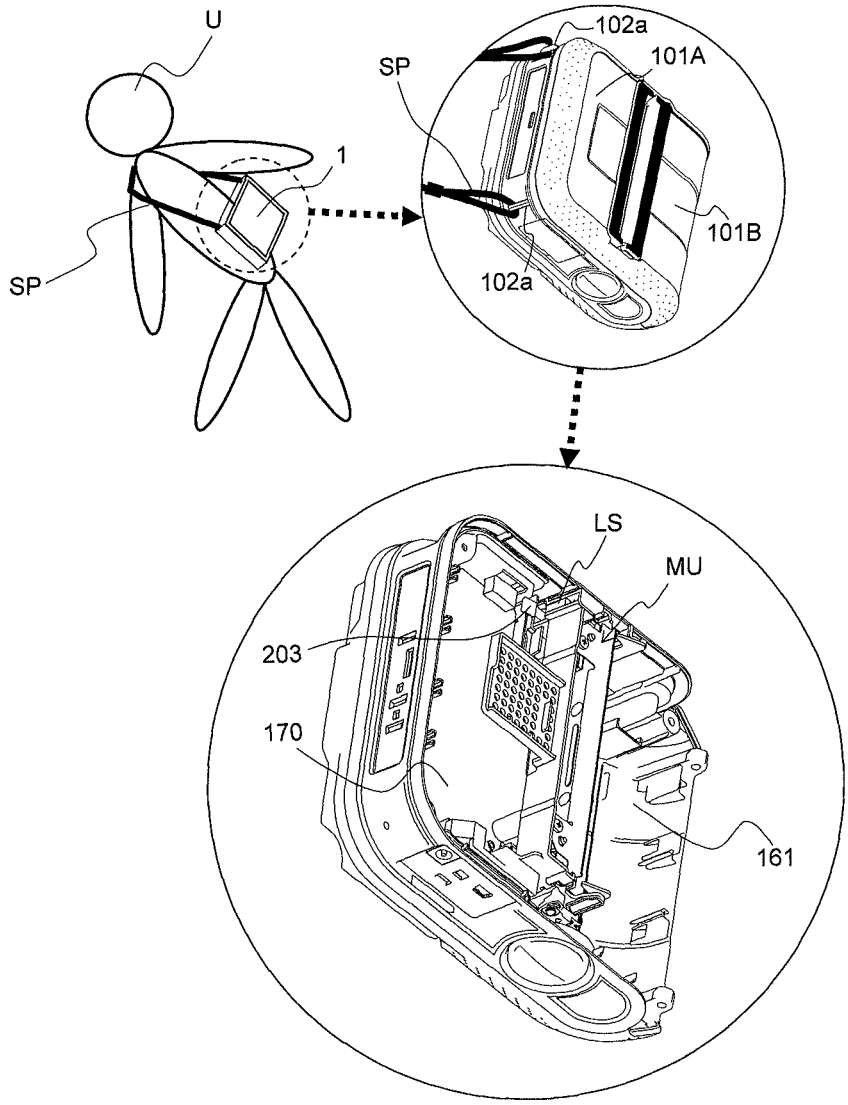
FIG. 14 is an explanatory view showing an example of the state of the printer when used by a user.

Furthermore, as shown in FIG. 14, when an operator U uses the printer 1 hung over his or her shoulder or from his or her waist via the strap SP inserted through the above described insertion part 102*a* so that the control substrate side 170 is on the top and the roll storage part 161 is on the bottom, the positional relationship in which the motion detection sensor LS is above and the motion output part 203 is below does not significantly change (as long as the printer 1 is not upside down), even if the printer 1 is generally somewhat slanted. Accordingly, it is possible to prevent the motion detection sensor LS from being exposed to spray, even when used in the form described above by the operator U.

Further, in particular, according to this embodiment, the end part 101C of the opening/closing lid 101B conforms with the edge part of the discharging exit 107. With this arrangement, once the opening/closing lid 101B is set to an open state and the end excess part of the rolled paper S is exposed, insertion of the rolled paper S into the above described discharging exit 107 can be achieved by simply closing the opening/closing lid 101B. As a result, it is possible to simplify the preparation operation performed by the operator prior to printing, improving user-friendliness.

Further, as described above, in the printer 1 of this embodiment, the control substrate 170 and the battery storage part 163 having large horizontal dimensions are layered and disposed vertically in the first area P, and the roll storage part 161 having a large vertical dimension is disposed alone in the second area Q. With this arrangement, the horizontal and vertical dimensions of the housing 100 are kept at the necessary minimum, making it possible to reliably reduce the overall size of the housing 100.

Further, in particular, according to this embodiment, the area between the second area Q, which can be opened to the outside, and the first area P, which has the control substrate 170, is sealed by the partition wall R and the mechanical unit MU. As a result, it is possible to improve the waterproof characteristics of the first area P wherein the control substrate 170 is disposed.

Further, in particular, according to this embodiment, the section of the second area Q that opposes the first protruding area part P2 of the first area P that protrudes rearward is established as the second base area part Q1 that recedes frontward. With this arrangement, it is possible to reduce the front-rear dimension of the housing 100 that is required when the first area P and the second area Q are disposed side by side in the front-rear direction. With this arrangement, it is possible to further reliably reduce the size of the housing 100.

Further, in particular, according to this embodiment, the thermal line head 112 and the platen roller 111 are provided above the partition wall R while the drive motor is disposed in the second protruding area part Q2 located to the side of the partition wall R, rather than above the partition wall R. With this arrangement, through coordination with the partition wall R, it is possible to fulfill the sealing function between the first area P and the second area Q while suppressing an increase in the vertical dimension of the housing 100 by the provision of the mechanical unit MU.

Further, in particular, according to this embodiment, the protruding substrate part 170*a* is disposed so that it enters below the main chassis member 150. With this arrangement, the protruding substrate part 170*a* is reliably isolated from the spray that can enter from the discharging exit 107, making it possible to improve waterproof characteristics.

Note that various modifications may be made according to the present embodiment without departing from the spirit and scope of the disclosure, in addition to the above-described embodiment.

Although other examples are not individually described herein, various changes and modifications can be made without departing from the spirit and scope of the present disclosure.

What is claimed is:

1. A printer comprising:

a substantially box-shaped housing that constitutes a printer contour;

a partition wall that partitions an internal structure of said housing into a first area positioned on a first side along a first direction orthogonal to a predetermined axis, and a second area positioned on a second side opposite to said first side along said first direction;

a control substrate provided to said first area;

a medium storage chamber configured to store a print-receiving medium wound around an axis into a roll shape and provided to said second area;

an opening/closing lid configured to expose said medium storage chamber to the outside and provided to said housing and configured to open and close around an end of said housing in said second area as a rotation axis between an open position and a closed position;

a print processing mechanism fixed by a screw fastening to a third side of said partition wall along a second direction orthogonal to said axis and said first direction; and a feeding roller, a head unit, and a motion transmission mechanism respectively arranged in said print processing mechanism, said feeding roller being provided to an end of said opening/closing lid in said first side and configured to feed said print-receiving medium supplied from said medium storage chamber based on control by said control substrate, said head unit having a printing head configured to perform desired printing on said print-receiving medium fed by said feeding roller, said motion transmission mechanism including:

a motion input part that is provided to said second area and is configured to contact a shaft end portion of said feeding roller provided to said opening/closing lid moving toward a fourth side opposite to said third side in said second direction and to move toward said fourth side;

a motion output part that is provided to said first area and is configured to convert the motion of said motion input part toward said fourth side and to output the converted motion as a motion toward said third side; and a motion detection sensor in said first area that is positioned further toward said third side than said motion output part, said motion detection sensor having a switch lever configured to receive a motion of said motion output part toward said third side and to move toward said third side.

2. The printer according to claim 1, wherein: said housing comprises a discharging exit configured to discharge said print-receiving medium on which print is formed by said print processing mechanism; and an end part of said opening/closing lid serves as an edge part of said discharging exit on said second side.

3. The printer according to claim 1, further comprising a battery storage part configured to store a battery for supplying power and provided to said housing on said fourth side of said first area wherein:

said control substrate is disposed in said housing on a third side of said first area and substantially along said first direction; and said printing head is configured to perform said desired printing on said print-receiving medium by the power of said battery stored in said battery storage part.

4. The printer according to claim 3, wherein:

said first area includes a first base area part and a first protruding area part provided to protrude from said first base area part toward said second side to enter said fourth side of said print processing mechanism;

said second area includes a second base area part and at least one second protruding area part disposed adjacent to said first protruding area part along said axis direction and provided to protrude further toward said first side than said second base area part;

said control substrate comprises a protruding substrate part disposed in said first protruding area part of said first area to enter said fourth side of said print processing mechanism; and said partition wall comprises a first partition part that extends along said axis direction to partition said first protruding area part and said second base area part, a second partition part positioned further toward said first side than said first partition part and that extends along said axis direction to partition said second protruding area part and said first base area part, and a third partition part provided to connect said first partition part and said second partition part and that extends along said first direction to partition said first protruding area part and said second protruding area part.

5. The printer according to claim 4, wherein:

said print processing mechanism further comprises a drive motor configured to drive said feeding roller provided opposite to said printing head with respect to a feeding path of said print-receiving medium;

said feeding roller and said printing head are disposed to be positioned on said third side of said third partition part of said partition wall; and said drive motor is disposed in said second protruding area part of said second area on said fourth side of an end part of a fifth side of said feeding roller and said printing head along said axis direction.

6. The printer according to claim 4, wherein:

said housing comprises a discharging exit configured to discharge said print-receiving medium on which printing is formed by said printing head at a position on said third side of said protruding substrate part of said control substrate.

7. The printer according to claim 1, further comprising a concave part provided to said head unit and configured to interlock said shaft end portion of said feeding roller, wherein said motion input part is configured to contact said shaft end portion when said shaft end portion is interlocked by said concave part.

8. The printer according to claim 7 wherein:

said motion transmission mechanism rocks around a rocking shaft positioned on said first side and more toward said fourth side than said concave part, as a rocking center.

* * * * *